US006339304B1

(12) United States Patent
Allison et al.

(10) Patent No.: US 6,339,304 B1
(45) Date of Patent: Jan. 15, 2002

(54) SWING CONTROL FOR ALTERING POWER TO DRIVE MOTOR AFTER EACH SWING CYCLE

(75) Inventors: Truman L. Allison, York; Daniel R. Mitchell, Morgantown; Dennis R. Stauffer, Birdsboro, all of PA (US)

(73) Assignee: Graco Children's Products Inc., Elverson, PA (US)

( * ) Notice: Subject to any disclaimer, the term of this patent is extended or adjusted under 35 U.S.C. 154(b) by 0 days.

(21) Appl. No.: 09/215,974

(22) Filed: Dec. 18, 1998

(51) Int. Cl.[7] ..... A63G 9/16
(52) U.S. Cl. ..... 318/443; 318/640; 472/119
(58) Field of Search ..... 318/560, 565, 318/567, 600, 601, 603, 626, 640, 652, 672, 686, 443, 444, 466, 467, 468; 388/907.5; 472/118, 119

(56) References Cited

U.S. PATENT DOCUMENTS

| | | | | |
|---|---|---|---|---|
| 3,883,136 A | * | 5/1975 | Kim | 272/86 |
| 4,785,678 A | * | 11/1988 | McGugan et al. | 74/42 |
| 4,911,429 A | * | 3/1990 | Ogbu | 272/86 |
| 5,378,196 A | * | 1/1995 | Pinch et al. | 472/119 |
| 5,525,113 A | | 6/1996 | Mitchell et al. | 472/119 |
| 5,769,727 A | * | 6/1998 | Fair et al. | 472/118 |
| 5,833,545 A | * | 11/1998 | Pinch et al. | 472/119 |
| 6,059,667 A | * | 5/2000 | Pinch | 472/119 |

FOREIGN PATENT DOCUMENTS

WO 96/11731 4/1996

OTHER PUBLICATIONS

Graco 1997 Product Catalog, "Swinging Success", Graco Children's Products Inc. (1997).
Graco 1986 Product Catalog, "Non–Stop Swyngomatic", Graco Children's Products Inc. (1986).

* cited by examiner

*Primary Examiner*—Bentsu Ro
(74) *Attorney, Agent, or Firm*—Foley & Lardner

(57) ABSTRACT

A control (200) for an infant and child swing (40) driven by a direct current motor (160) includes a user interface (312) for selecting from a plurality of swing heights (or amplitudes), a microcontroller (400) having a processor (401), a swing angle indicator (118) having a light interrupter detector (210), and a music system (410). Processor (401) receives an output signal from light interrupter detector (210) for monitoring the current swing amplitude. At the end of each swing cycle processor (401) compares the current swing amplitude with the user selected maximum swing amplitude, and, if not substantially equal, generates a control signal to adjust the power output from motor (160) so that the current swing amplitude substantially equals the user selected maximum swing amplitude. This cycle-by-cycle adjustment produces a swing arc having improved accuracy and consistency. Processor (401) also ends operation of motor (160) after an optional, user preselected, fixed time period, and facilitates maintenance and repair by displaying the status of light interrupter detector (210) upon selected actuation of user interface (312).

15 Claims, 6 Drawing Sheets

SWING CONTROL FOR ALTERING POWER TO DRIVE MOTOR AFTER EACH SWING CYCLE

TECHNICAL FIELD

The present invention relates in general to swings such as those used by infants or children. More particularly, the present invention pertains to control systems for such swings. More specifically, the present invention relates to control systems for swings having at least two user-selectable swing heights.

BACKGROUND ART

Swings such as those used by infants or children have been contemplated in the past. In U.S. Pat. No. 5,525,113 to Mitchell et al. an open top swing and control is described using a unique swing drive mechanism having a direct current electric motor and a control to provide three selective swing height (also called amplitude) settings. The control device selectively outputs either no voltage, first (low), second (medium), or third (high) predetermined voltages to achieve the user selected swing height by selectively controlling the voltage input to the motor. In other words, for a given selected swing height, this control device outputs the same fixed output voltage for all swings and all children. This control device also includes a sensor for detecting swing height, and cutting off or reducing to a lower magnitude the fixed voltage output for the selected swing height once a fixed, preselected height has been detected.

The output of a constant, preselected voltage to the motor generates a constant energy with which to operate the swing. However, a swing acts as a pendulum and the energy required to move a pendulum through a swing cycle is not constant, but varies with the pendulum's weight and its distribution, and the swing amplitude. Moreover, manufacturing variations in components such as the drive motor create further significant alteration in the energy actually required to achieve a desired swing height for a specific child in a specific swing. For these reasons different swings require different energies to achieve the same swing height. Furthermore, the same swing requires different energy to achieve the same swing height for children of different weight and size. Output of the same, fixed motor voltage for all swings and all children results in variations in swing height from swing to swing and child to child.

We have realized that by varying with each swing cycle the energy produced by the swing motor based on the actual swing cycle, variations in swing arc can be minimized, more accurate and consistent swing cycles can be produced, and the reliability of self-starting improved.

SUMMARY OF THE INVENTION

It is, therefore, an object of the present invention to provide a swing control in which the swing cycle is monitored and the energy produced by the swing motor to drive the swing is reviewed for adjustment and, if desired, adjusted, no less frequently than once each swing cycle, thereby improving the accuracy and consistency of swing arc.

It is another object of the present invention to provide a swing control, as set forth above, in which actual swing height is determined for each swing cycle, compared to the user selected swing height, and, in the event of a difference greater than a preselected threshold magnitude, the energy produced by the swing motor to drive the swing is adjusted.

It is still another object of the present invention to provide a swing control, as set forth above, for a swing driven by a motor whose output energy is controlled by the voltage applied at its input, in which the voltage applied to the motor is varied each time the swing changes direction and its swing height is not approximately the user selected swing height.

It is yet another object of the present invention to provide a swing control, as set forth above, in which a plurality of prefixed operating times are available for selection by the user, after which the swing automatically ceases operation.

It is a further object of the present invention to provide a swing control, as set forth above, in which music, at several volume levels, is available for selection by the user.

It is still a further object of the present invention to provide a swing control, as set forth above, including means to facilitate maintenance and repair.

It is yet a further object of the present invention to provide a swing control, as set forth above, including a test mode of operation during which the current output state of the swing height monitor is presented visually to the user.

These and other objects and advantages of the present invention over existing prior art forms will become more apparent and fully understood from the following description in conjunction with the accompanying drawings.

In general, a device for controlling the amplitude of a swing includes a motor for driving the swing, a swing amplitude detector monitoring the current swing amplitude and generating a swing amplitude signal a characteristic of which is representative of the current swing amplitude, and a processor. The processor receives the swing amplitude signal, compares the current swing amplitude when the swing changes direction with a preselected maximum swing amplitude, and generates a control signal adjusting the output power of said motor when the current swing amplitude is not substantially equal to the preselected maximum swing amplitude.

A method for controlling the amplitude of a swing having a drive motor, includes the steps of monitoring the current swing amplitude, generating a swing amplitude signal a characteristic of which is representative of said current swing amplitude, comparing the current swing amplitude when the swing changes direction with a preselected maximum swing amplitude; and, adjusting the output power of the motor when the current swing amplitude is not substantially equal to the preselected maximum swing amplitude.

PREFERRED EMBODIMENT FOR CARRYING OUT THE INVENTION

Figure 1:
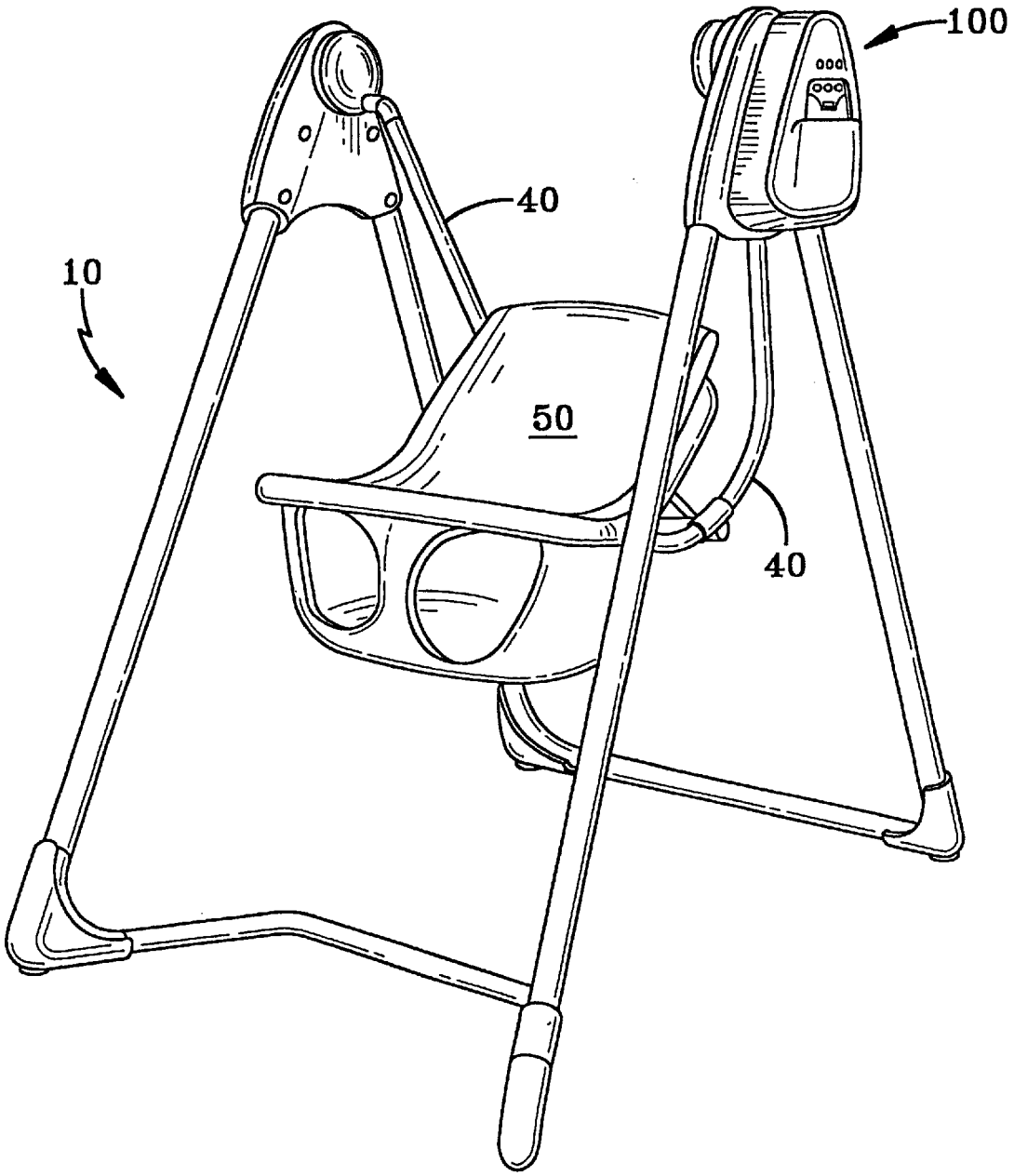
FIG. 1 is a perspective view of an exemplary swing with which a control in accordance with the present invention may operate. This exemplary swing is similar generally to the exemplary swing shown in FIG. 1 of U.S. Pat. No. 5,525,113, and is depicted generally with like numerals.

An exemplary swing control in accordance with the present invention may work with a wide variety of swings. One such swing is described in U.S. Pat. No. 5,525,113 to Mitchell et al. (hereinafter referred to as the '113 Patent), which is incorporated by reference as if completely set forth herein. FIG. 1 is a perspective view of an exemplary swing that is similar generally to the exemplary swing shown in FIG. 1 of the '113 Patent, and is depicted generally with like numerals. The baby and child's swing of FIG. 1 has an open top design, a support frame 10 which holds a swing drive mechanism 100, a pair of hangers 40, and a seat 50.

Figure 2:
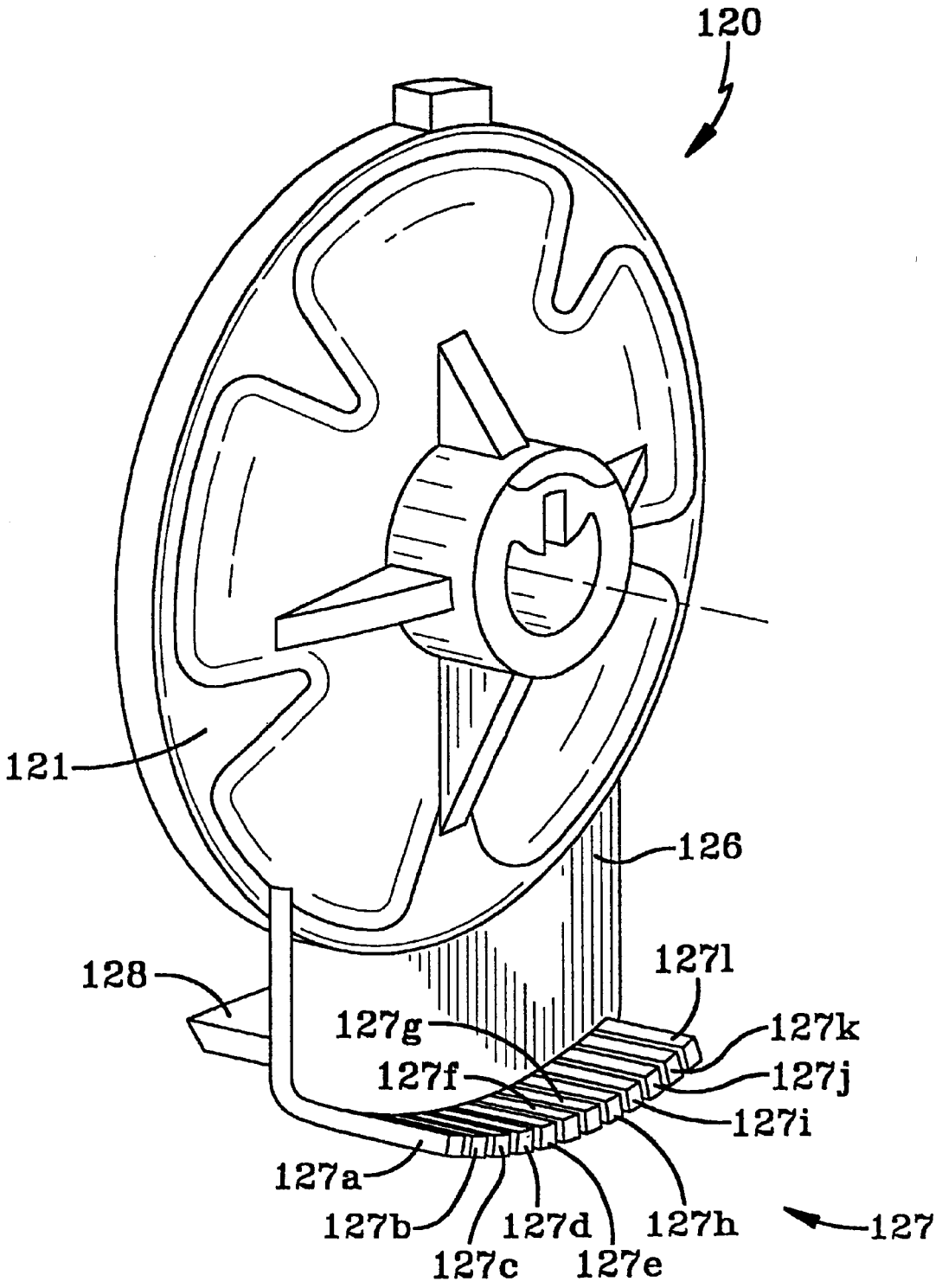
FIG. 2 is a perspective view of an exemplary drive flange with which the exemplary swing shown in FIG. 1 and a control in accordance with the present invention may operate. This exemplary flange is similar generally to the exemplary flange shown in FIG. 11 of U.S. Pat. No. 5,525,113, and is depicted generally with like numerals. The drive flange of FIG. 2 includes a swing angle indicator suitable for use with a control in accordance with the present invention and differing from that presented in FIG. 11 of U.S. Pat. No. 5,525,113.

FIG. 2 is a perspective view of an exemplary drive flange 120 with which the exemplary swing shown in FIG. 1 and a control in accordance with the present invention may operate. This exemplary flange is similar generally to the exemplary flange shown in FIG. 11 of the '113 Patent, and is depicted generally with like numerals. A swing angle indicator 118 suitable for use with a control in accordance with the present invention and differing from that presented in FIG. 11 of the '113 Patent, includes the drive flange 120 of FIG. 2. The drive flange 120 has a disc member 121, and a radial extension 126 from which extends abutment 128 and, in the embodiment depicted herein, a plurality of twelve prongs 127, individually identified by numerals 127*a* through 1271, inclusive. Prongs 127 are about 2° in width and about 4° on centers.

Figure 3:
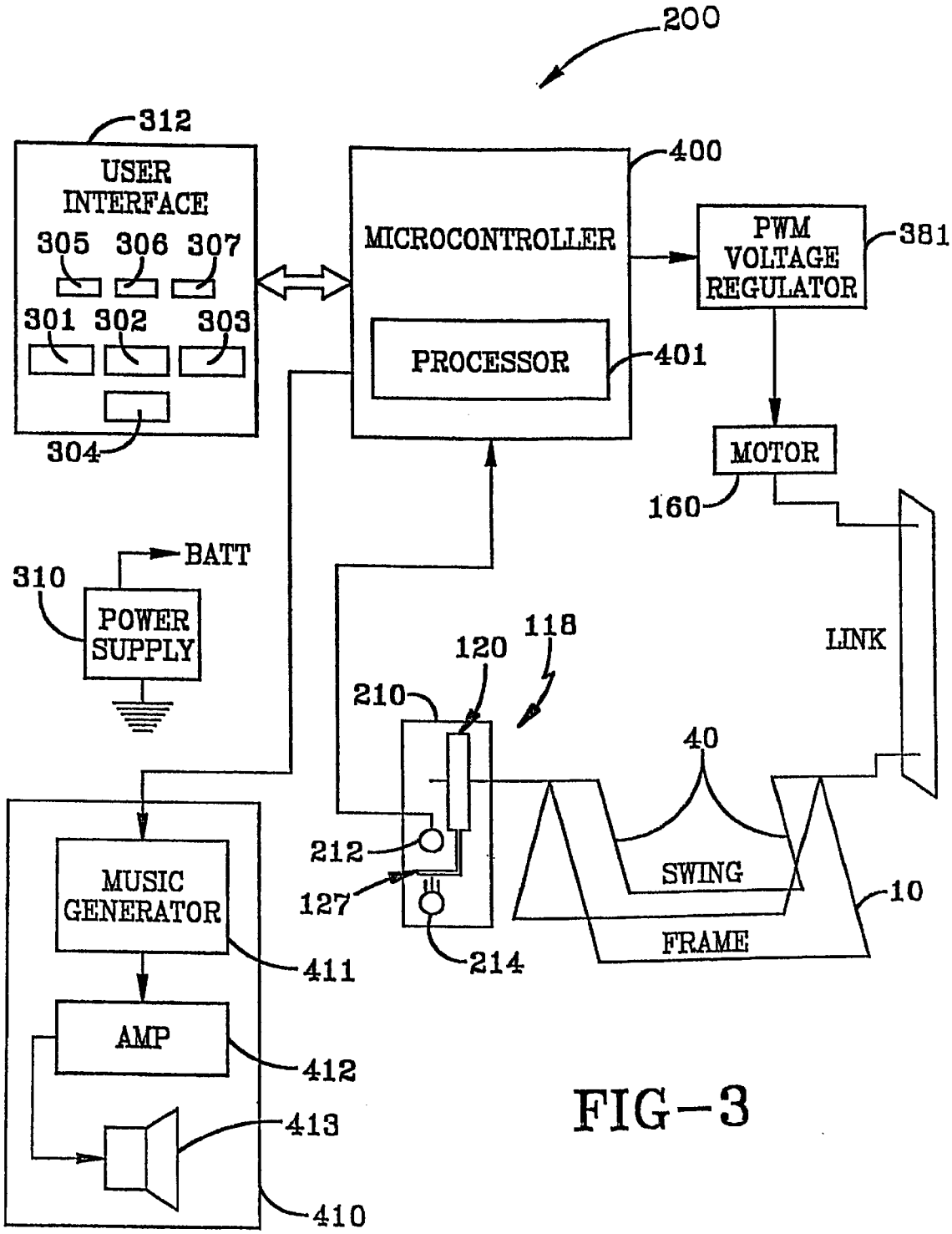
FIG. 3 is a block diagram of an exemplary swing control in accordance with the present invention, and includes a diagrammatic presentation of an exemplary controlled swing and swing drive motor.

FIG. 3 is a block diagram of an exemplary swing control in accordance with the present invention, indicated generally by the numeral 200, and also illustrates diagrammatically swing 40 and swing drive motor 160. As described in the '113 patent a user interface 312 may include inputs such as four momentary pushbuttons 301, 302, 303 and 304, and a display having three bicolor (e.g., red and green) light emitting diodes (LEDs) 305, 306 and 307. A power supply 310 furnishes electrical power to all components of swing control 200. Swing control 200 further includes a microcontroller 400 having an internal processor 401, and an optional music system 410 having a music generator 411, amplifier 412 and a speaker 413. Pulse width modulation (PWM) voltage regulator 381 receives an output control signal from microcontroller 400 and generates a suitable, corresponding signal to motor 160. A swing amplitude detector such as light interrupter detector 210, whose output signal is received by microcontroller 400, includes an optical source such as infrared light emitting diode (IRLED) 214 generating light to pass through spaces between prongs 127 to be received by optical sensor such as photodetector or phototransistor 212.

While, microcontroller 400 may be selected from nearly any of the commercially available microcontrollers having adequate input/output capacity and memory to execute the functionality described below, it is desirable for microcontroller 400 to not be excessive in size, power or cost, and to include a sleep mode for reducing power consumption while the swing is not in use, a watchdog circuit to resolve internal processor lockups, and a real time clock counter. Suitable microcontrollers include the model series 16C5x manufactured by Microchip Technology Inc. of Chandler, Ariz., the model series 68HC08 or 68HC11 manufactured by Motorola, Inc. of Austin, Tex., and the model series Z8 manufactured by Zilog, Inc. of Campbell, Calif.

Music generator 411 may be any commercially available music chip including preselected music, such as those made by Techno Mind, Ltd. of Hong Kong or Holtek of Taiwan. Amplifier 412 may be selected from any of the common audio amplifiers well known to the skilled artisan for driving a small (e.g., 29 mm), low power (e.g., 32 ohm impedance) speaker.

The primary function of swing control 200 is to operate swing 40 with a smoothly varying angular velocity to the swing height chosen by the user through user interface 312. This is accomplished by monitoring swing angular velocity and total swing arc and appropriately adjusting power to motor 160.

Swing control 200 calculates swing angular velocity from the time intervals between transitions detected by light interrupter detector 210. Total swing arc is found by counting transitions from one minimum velocity to the next minimum velocity, because the angular velocity of a pendulum decreases to zero at the ends of its arc. Total swing arc is compared to the desired swing arc, and power to motor 160 increased if the swing angle is less than desired, or decreased if the swing angle is more than desired. Power to motor 160 is limited at low amplitudes no matter what the desired or actual swing arc to enhance the ability of motor 160 to initiate motion of swing 40.

In the exemplary embodiment illustrated herein the user is given the choice of six swing amplitudes, a plurality of preselected run times (e.g., 10, 20, 30 and 40 minutes), and music which may be turned on or off and played at several volumes (high, medium, and low). These features may be selected by actuating various preselected combinations of momentary pushbuttons 301, 302, 303 and 304, which may be referred to herein as, and labeled high swing, low swing, timer and music, respectively. For example, music is initiated or terminated, and its volume selected, by successive momentary activations of switch 304. Pressing and holding any of pushbuttons 301, 302, 303 and 304 will turn off the function controlled by that pushbutton.

A visual indication of the selected swing amplitude is furnished to the user from which LED is illuminated and its color. A visual indication of the selected timer option is furnished by the current swing amplitude LED blinking on and off for a number of times corresponding to the remaining run time (e.g., one blink equals ten minutes remaining, two blinks equals twenty minutes remaining, etc.). A visual indication of low battery is presented periodically by the normal red or green LEDs momentarily glowing yellow.

Swing control 200 may include optional features to facilitate maintenance or repair. For example, the embodiment described herein includes a "test mode" to check the integrity of the light interrupter detector 210. This test mode may be initiated by actuating a momentary pushbutton, say 304, for a slightly extended time period (e.g., two seconds), whereupon the status of the light interrupter detector 210 is displayed by turning on all LEDs if photodetector 212 is receiving light from IRLED 214, and turning off all LEDs if photodetector 212 is not receiving light from IRLED 214. The test mode ends upon release of pushbutton 304.

Figure 4:
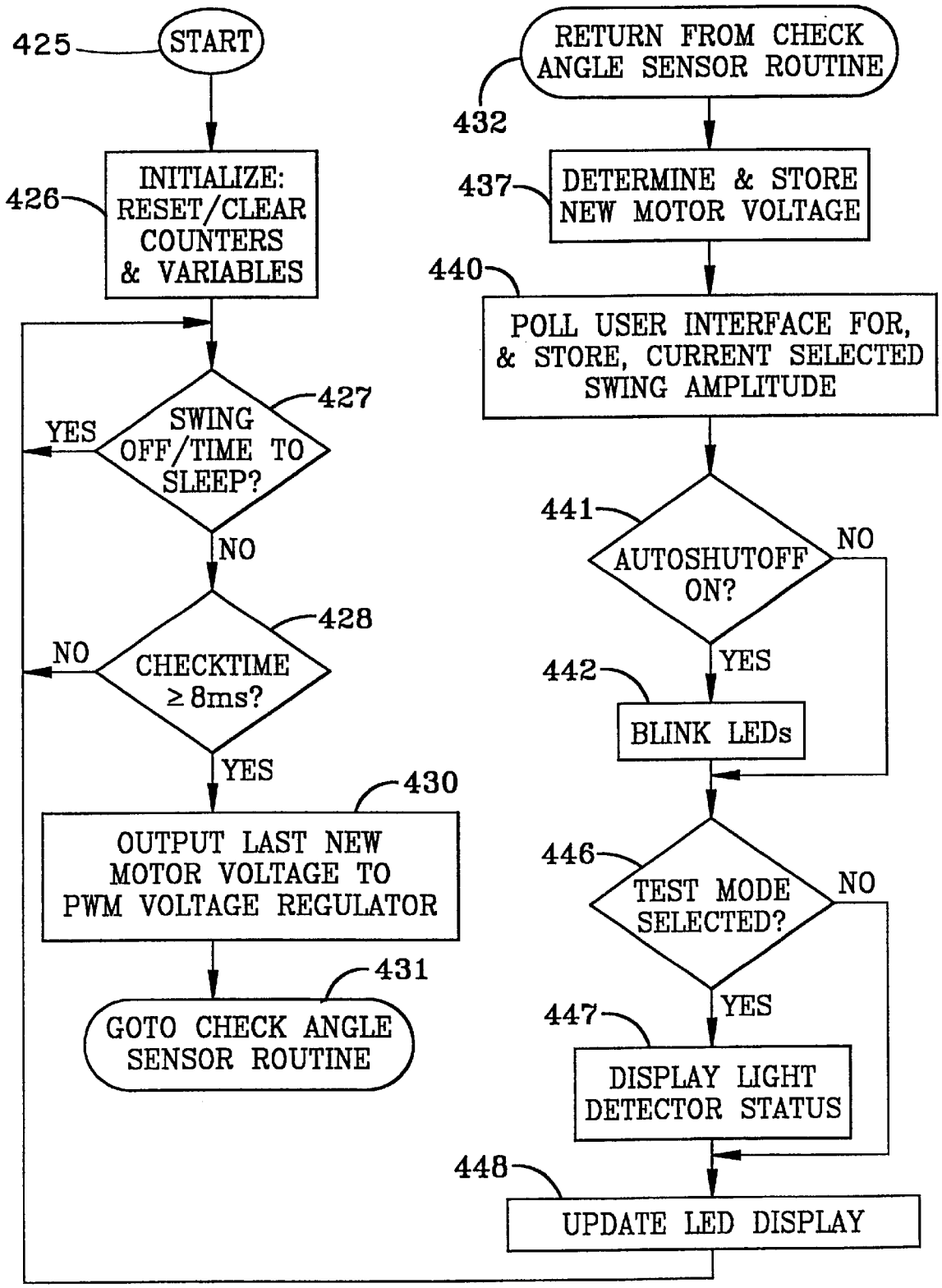
FIG. 4 is an exemplary top-level flow chart of an exemplary swing control in accordance with the present invention.
Figure 5:
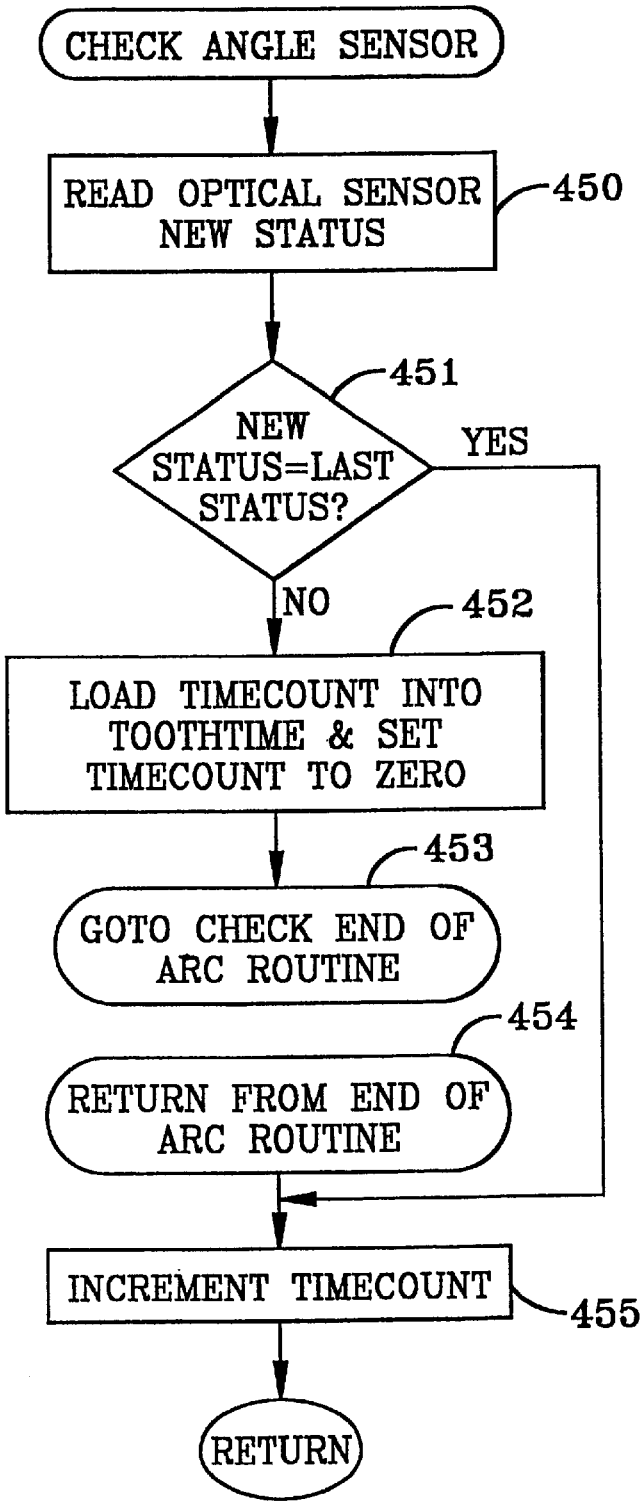
FIG. 5 is a top-level flow chart of an exemplary angle check routine for determining the current angular position of the swing in its swing cycle.
Figure 6:
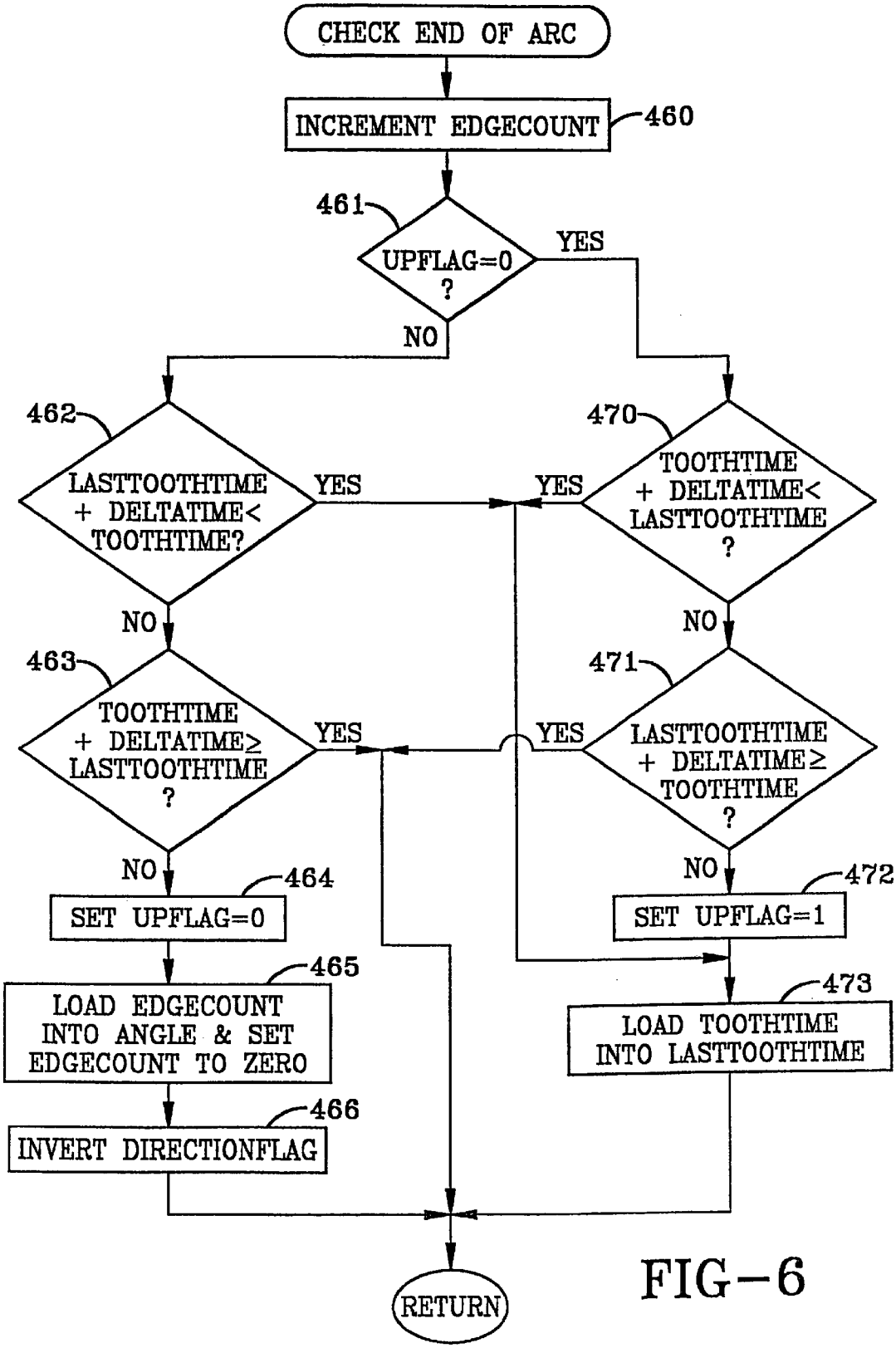
FIG. 6 is a top-level flow chart of an exemplary end of arc check routine for determining whether the swing has reached the end of its swing cycle and changed directions.

FIGS. 4, 5 and 6 present top-level flow charts for an exemplary algorithm executed by swing control 200 in accordance with the present invention. More particularly, FIG. 4 depicts an exemplary main control routine whose operation is begun at start 425 with an initialization of hardware and software counters and variables (block 426). Next, in step 427 a test is conducted to determine if the user has turned off swing control 200 or microcontroller 400 otherwise finds it is time to power down (i.e., "sleep"). If so, the test of step 427 is repeatedly conducted until it is time to power up.

A polling timer, called CHECKTIME, is then examined in step 428 to see if the time that has lapsed since the last execution of the check angle sensor routine equals or exceeds some preselected delay, say 8 milliseconds. This delay is included because swing 40 moves very slowly relative to the operation of microcontroller 400, even during high velocity portion of a high amplitude swing, and if a delay was not introduced the count before the occurrence of the next edge of prong 127 would be much greater, necessitating use of a higher capacity and more expensive counter. In short, CHECKTIME allows use of a counter having reasonable, but not excessive resolution.

If the value of CHECKTIME is not equal to or greater than the preselected constant 8 ms, operation returns to test for sleep time in step 427. If the value of CHECKTIME is equal to or greater than the preselected constant 8 ms, microcontroller 400 outputs in step 430 the last new motor voltage to pulse width modulated (PWM) voltage regulator, and then proceeds in step 431 to go to the Check Angle Sensor Routine. Upon completion of the Check Angle Sensor Routine, operation is returned to the main control routine in step 432, and a new motor voltage appropriate to the present swing angular velocity and total swing arc, and user selected swing height, is determined and stored in step 437. As is well known to the ordinarily skilled artisan, this determination may be made, for example, by real time calculation, or by reference to a lookup table including precalculated values.

In step 440 user interface 312 is polled for the current selected swing amplitude, and that amplitude is held in memory. Next a check in step 441 is made whether the selected timer feature (referred to in FIG. 4 as "autoshutoff") is activated, and if so, the LEDs are blinked in step 442 as explained hereinbefore. Step 446 tests whether the test mode operation noted hereinbefore has been selected, and if so the LEDs are actuated in step 447 as explained hereinbefore. Finally, in step 448 the LED display is appropriately updated to reflect the current pushbutton status (e.g., selected swing amplitude).

FIG. 5 presents the check angle sensor routine called in step 431, and functions to determine if another prong 127 edge has passed light interrupter detector 210. In step 450 the current output of photodetector 212 or other optical sensor is read by microcontroller 400, and its status (light or dark) compared in step 451 to the last check output of photodetector 212 held in a variable called LASTSTATUS. If the current status is unchanged (i.e., the same as in LASTSTATUS), a counter variable called TIMECOUNT is incremented in step 455 and operation returned to the main control routine. If the current status has changed, in step 452 the present TIMECOUNT is passed to a variable TOOTHTIME, and TIMECOUNT is reset to zero after which another routine to determine if swing 40 is at the end of its arc is called in step 453. Upon completion of the end of arc routine, operation is returned to the main control routine.

The end of arc routine uses a variable EDGECOUNT to count the number of edges that have been detected by light interrupter detector 210 for each arc of swing 40. The end of a swing arc is determined by comparing the time interval between the last two edges found by light interrupter detector 210 (held in the variable TOOTHTIME) with the time interval between the second to last and third to last occurring edges (held in the variable LASTTOOTHTIME). It has been found desirable to add a small, constant magnitude to the variables TOOTHTIME AND LASTTOOTHTIME before making this comparison in order to avoid the occurrence of false ends of arc due to manufacturing variations in the edges of prongs 127.

The current trend of longer or shorter time intervals is held in a flag, called UPFLAG which, for example, may be assigned the logic value 0 for time intervals that are growing shorter, and assigned the logic value 1 for time intervals that are growing longer. When the current trend changes from longer to shorter intervals, then the end of a swing arc has been reached.

Thereafter, the total number of edges counted in EDGECOUNT is loaded into a variable called ANGLE, a variable DIRECTIONFLAG is toggled, and the variable EDGECOUNT is set to zero to monitor the next arc amplitude.

Turning now to FIG. 6, the specific check end of arc routine may be reviewed beginning with step 460 in which the variable EDGECOUNT is incremented, and followed by a test of whether the current trend of time intervals between edges is shorter, i.e., the variable UPFLAG equals zero. If not, the variable LASTTOOTHTIME is added to the constant DELTATIME and the sum tested in step 462 to see if it is less than TOOTHTIME. If so, TOOTHTIME is loaded into LASTTOOTHTIME in step 473, and the check end of arc routine returned to the check angle sensor routine. If not, the variable TOOTHTIME is added to the constant DELTATIME and the sum tested in step 463 to see if it equals or is greater than LASTTOOTHTIME. If so, TOOTHTIME is loaded into LASTTOOTHTIME in step 473, and the check end of arc routine returned to the check angle sensor routine. If not, the flag UPFLAG is set to zero in step 464 because the current trend of time intervals between edges is still shorter, and, in step 465 EDGECOUNT is loaded into the variable ANGLE and EDGECOUNT is set to zero. After the variable DIRECTIONFLAG is inverted in step 466, the check end of arc routine is returned to the check angle sensor routine.

If in step 461 the flag UPFLAG is not equal to zero (i.e., the current trend of time intervals between edges is longer), in step 470 the variable TOOTHTIME is added to the constant DELTATIME, and the sum tested if less than LASTTOOTHTIME. If so, TOOTIITIME is loaded into LASTTOOTHTIME in step 473, and the check end of arc routine returned to the check angle sensor routine. If not, the variable LASTTOOTHTIME is added to DELTATIME and the sum tested if equal to or greater than TOOTHTIME. If not, the flag UPFLAG is set to one in step 472 because the current trend of time intervals between edges is longer, and, in step 473, TOOTHTIME is loaded into LASTTOOTHTIME, and the check end of arc routine returned to the check angle sensor routine. If so, the check end of arc routine is returned to the check angle sensor routine.

Inasmuch as the present invention is subject to variations, modifications and changes in detail, some of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the art of controlling swing amplitude and other operation.

What is claimed is:

1. A device for controlling the amplitude of a swing cycle, comprising:

a motor for driving the swing;

a swing amplitude detector monitoring the current swing amplitude and generating a swing amplitude signal a characteristic of which is representative of the current swing amplitude; and a processor receiving said swing amplitude signal, comparing the current swing amplitude at least once each swing cycle with a preselected swing amplitude selected from a plurality of selectable swing amplitudes, and generating a control signal adjusting the output power of said motor when the current swing amplitude is not substantially equal to said preselected swing amplitude.

2. A device, as set forth in claim 1, wherein said processor compares the current swing amplitude when the swing changes direction, and said preselected swing amplitude is a preselected maximum swing amplitude.

3. A device, as set forth in claim 2, wherein said motor is a direct current motor whose output power is controlled by its input voltage, said processor varying a characteristic of said control signal whereby said input voltage to said motor is adjusted to the output power necessary for the swing amplitude to substantially equal said preselected maximum swing amplitude.

4. A device, as set forth in claim 3, wherein said processor varies the voltage of said control signal.

5. A device, as set forth in claim 1, further including a microcontroller, said processor included in said microcontroller.

6. A device, as set forth in claim 1, further including a user interface for user selection of the swing amplitude from a plurality of preselected swing amplitudes, and a display for displaying the selected swing amplitude.

7. A device, as set forth in claim 6, wherein said processor ends operation of said motor after a preselected, fixed period of time, and said user interface includes an input for selection of said fixed period of time.

8. A device, as set forth in claim 7, wherein said swing amplitude detector includes a light interrupting detector having an light source, a light detector receiving light from said light source and generating a signal a characteristic of which is representative of the presence and absence of light, and a light interrupter that repeatedly interrupts and passes said light from said light source to said light detector as the swing moves tlirough its arc.

9. A device, as set forth in claim 1, further including a music system having a music generator generating audio, an amplifier receiving and amplifying said audio, and a speaker receiving and broadcasting said amplified audio.

10. A method for controlling the amplitude of a swing having a drive motor and swing cycle, comprising the steps of:

monitoring the current swing amplitude;

generating a swing amplitude signal a characteristic of which is representative of said current swing amplitude;

comparing said current swing amplitude at least once each cycle with a preselected swing amplitude selected from a plurality of selectable swing amplitudes; and adjusting the output power of the motor when said current swing amplitude is not substantially equal to said preselected swing amplitude.

11. A method, as set forth in claim 10, wherein said step of comparing said current swing amplitude includes the step of comparing said current swing amplitude when the swing changes direction with a preselected maximum swing amplitude, and said step of adjusting the output power of the motor occurs when said current swing amplitude is not substantially equal to said preselected maximum swing amplitude.

12. A method, as set forth in claim 10, including the further step of generating a control signal for adjusting the output power of the motor when said current swing amplitude is not substantially equal to said preselected swing amplitude.

13. A method, as set forth in claim 10, including the further steps of selecting a fixed period of time after which operation of the swing ends, and ending operation of the motor after said selected fixed period of time.

14. A device for controlling the amplitude of a swing having a swing cycle, comprising:

a motor for driving the swing;

a swing amplitude detector for monitoring the current swing amplitude and generating a swing amplitude signal, a characteristic of which is representative of the current swing amplitude;

a processor receiving said swing amplitude, comparing the current swing amplitude at least once each swing cycle with a preselected swing amplitude, and generating a control signal adjusting the output power of said motor when the current swing amplitude is not substantially equal to said preselected swing amplitude;

a user interface for user selection of the swing amplitude from a plurality of preselected swing amplitudes; and a display for displaying the selected swing amplitude and the current status of said swing amplitude detector, and said user interface includes an input for actuating display of the current status of said swing amplitude detector.

15. A method for controlling the amplitude of a swing having a drive motor and swing cycle, comprising the steps of:

monitoring the current swing amplitude by generating a light, repeatedly interrupting said light as the swing moves through its arc, detecting presence and absence of said light, and displaying on a user interface the detection of the presence and absence of said light;

generating a swing amplitude signal, a characteristic of which is representative of said current swing amplitude;

comparing said current swing amplitude at least once each cycle with a preselected swing amplitude; and adjusting the output power of the motor when said current swing amplitude is not substantially equal to said preselected swing amplitude.

* * * * *